US008662432B2

(12) United States Patent
Smith et al.

(10) Patent No.: US 8,662,432 B2
(45) **Date of Patent: *Mar. 4, 2014**

(54) BALL TUBE MILL TRUNNION SEAL

(71) Applicant: Riley Power Inc., Worcester, MA (US)

(72) Inventors: Daniel P. Smith, Spencer, MA (US); George King, Ware, MA (US); John Sund, Oakham, MA (US); Paul Knight, Spartanburg, SC (US)

(73) Assignee: Riley Power, Inc., Worcester, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/875,684

(22) Filed: May 2, 2013

(65) Prior Publication Data

US 2013/0241155 A1 Sep. 19, 2013

Related U.S. Application Data

(63) Continuation of application No. 12/201,609, filed on Aug. 29, 2008, now Pat. No. 8,448,888.

(51) Int. Cl.
*B02C 17/14* (2006.01)

(52) U.S. Cl.
USPC ..... 241/178; 241/177; 241/180; 241/182

(58) Field of Classification Search
CPC ..... F27B 7/24; B02C 17/06; B02C 17/002
USPC ..... 277/903, 349, 351, 403; 241/176–183, 241/299
See application file for complete search history.

(56) References Cited

U.S. PATENT DOCUMENTS

| | | | | |
|---|---|---|---|---|
| 1,590,655 | A | | 6/1926 | Spicer |
| 1,607,828 | A | | 11/1926 | Holthoff et al. |
| 1,794,454 | A | | 3/1931 | Green |
| 2,360,345 | A | | 10/1944 | Hilkemeier |
| 2,456,073 | A | * | 12/1948 | Newhouse ..... 241/67 |
| 2,486,477 | A | | 11/1949 | Kennedy |
| 2,797,940 | A | * | 7/1957 | Michener, Jr. et al. ..... 277/353 |
| 3,047,242 | A | | 7/1962 | Genier |
| 3,383,115 | A | | 5/1968 | Eckley et al. |
| 3,401,893 | A | * | 9/1968 | Reynolds ..... 241/171 |
| 3,549,094 | A | * | 12/1970 | Kurtz ..... 241/171 |
| 3,599,947 | A | | 8/1971 | Sherwood et al. |
| 3,601,323 | A | * | 8/1971 | Giencke ..... 241/70 |
| 3,604,639 | A | | 9/1971 | Jenness |
| 3,746,268 | A | | 7/1973 | Kastrinos et al. |
| 4,133,718 | A | | 1/1979 | Jaquay |

(Continued)

*Primary Examiner* — Vishal Patel
*Assistant Examiner* — Nathan Cumar
(74) *Attorney, Agent, or Firm* — Edwards Wildman Palmer LLP; Joshua L. Jones

(57) ABSTRACT

A trunnion seal assembly for joining a stationary inlet/outlet box of a ball tube mill to a rotational interior of the ball tube mill includes an outer ring component configured to be mounted to an outer wall of the stationary inlet/outlet box. An inner ring component is joined to the outer ring component substantially concentrically with the outer ring component. A flexible pad seal is configured to be joined to the outer wall of the stationary inlet/outlet box proximate outer ring component. The pad seal includes a first annular sealing surface. A mill head extension ring configured to be joined to a rotational mill head is located proximate to and substantially concentric with the inner ring component. The mill head extension includes a second annular sealing surface sealingly engaged with the first annular sealing surface of the flexible pad seal.

9 Claims, 10 Drawing Sheets

(56) References Cited

U.S. PATENT DOCUMENTS

| | | | | | |
|---|---|---|---|---|---|
| 4,199,155 | A * | 4/1980 | Day et al. | 277/377 |
| 4,338,868 | A | 7/1982 | Lientz | |
| 4,795,572 | A | 1/1989 | LaValley | |
| 4,874,349 | A * | 10/1989 | Gall | 464/14 |
| 4,966,471 | A | 10/1990 | Trozzi | |
| 5,000,462 | A | 3/1991 | Trozzi | |
| 5,361,997 | A * | 11/1994 | Burkes | 241/70 |
| 5,814,273 | A | 9/1998 | Nielsen | |
| 6,550,778 | B1 * | 4/2003 | Zutz | 277/358 |
| 2006/0249610 | A1 | 11/2006 | Bliss et al. | |
| 2009/0058016 | A1 * | 3/2009 | Smith et al. | 277/607 |

* cited by examiner

BALL TUBE MILL TRUNNION SEAL

CROSS-REFERENCE TO RELATED APPLICATIONS

This application is a continuation of U.S. patent application Ser. No. 12/201,609 filed Aug. 29, 2008, which claims priority to U.S. Provisional Patent Application Ser. No. 60/968,784 filed Aug. 29, 2007, both of which are incorporated by reference herein in their entirety.

BACKGROUND OF THE INVENTION

1. Field of the Invention

The present invention relates to a systems and methods for sealing trunnions, and more particularly to systems and methods for sealing trunnions of ball tube mills for pulverizing materials.

2. Background of the Related Art

Ball tube mills are used in material size reduction processes, such as grinding coal or other minerals. A typical ball tube mill includes a large, cylindrical drum that rotates along its axis, supported by a trunnion on each end. As the drum rotates, a mass of balls and coal or other material mix in the bottom of the drum, which reduces the particle size of the coal or other material. Particles that are fine enough become airborne and are vented out of the drum for use in further processes such as coal combustion. New coal or other material enters through the ends of the drum to replace the airborne particles leaving the ends of the drum.

In order to move material between the rotating drum and related stationary components such as a coal piping system, for example, the rotating drum typically connects at each end to a stationary inlet/outlet box via a trunnion seal. The trunnion seal allows passage of material between the rotating drum and the stationary inlet/outlet box while discouraging or preventing material from escaping into the surroundings. It is advantageous to form the best possible seal between stationary and rotating components, as the fine particles involved can readily escape if the seal is inadequate. When operating a ball tube mill, the trunnion seals wear down and eventually need to be replaced. This can be exacerbated by the fact that the rotating axis of the mill tends to move downward as its bearings wear with use. Replacing the trunnion seals typically requires removing the inlet/outlet box from foundation blocks under the trunnions, which results in significant downtime.

Such conventional methods and systems generally have been considered satisfactory for their intended purpose. However, there still remains a continued need in the art for a trunnion seal that has an improved service life and is easier to install and remove. The present invention provides a solution for these problems.

SUMMARY OF THE INVENTION

The subject invention is directed to a new and useful trunnion seal for a ball tube mill. The trunnion seal includes a stationary ring component configured to be mounted around an inlet/outlet passage of a ball tube mill. A flexible pad seal is joined to the stationary ring component. The pad seal includes a first annular sealing surface. A mill head extension ring is configured to be joined to a rotational mill head proximate to and substantially concentric with the stationary ring component. The mill head extension includes a second annular sealing surface sealingly engaged with the first annular sealing surface of the flexible pad seal. The first and second annular sealing surfaces form a seal to discourage passage of particles within the mill passing into the surrounding air.

In one aspect of the invention, the trunnion seal can further include a seal sleeve joined to the stationary ring component and having an outward facing seal face around the circumference thereof for engagement to an inward facing seal face of the mill head extension ring. At least one of the inward facing seal face of the mill head extension ring and the outward facing seal face of the stationary ring component can be grooved. An air seal channel can be defined between the seal sleeve, pad seal, and stationary ring component. It is contemplated that the second annular sealing surface can be generally convex, concave, flat, or any other suitable shape.

The invention also provides a trunnion seal ring for a ball tube mill. The seal ring includes an outer ring component configured to be mounted to an outer wall of a stationary inlet/outlet box of a ball tube mill The outer ring component includes an outer filler body defined along a chord of a circle defined by the inner circumference of the outer ring component. An inner ring component includes an inner filler body defined along a chord of a circle defined by the inner circumference thereof. The inner ring component is joined to the outer ring component substantially concentrically with the inner and outer filler bodies defining a filler having a substantially triangular cross-sectional profile.

In another aspect, the inner and outer ring components are configured to be assembled into a ball tube mill by positioning the inner ring component partially into the ball tube mill so the inner ring component is substantially concentric with the ball tube mill, then inserting the outer ring component axially outside the inner ring component and into alignment therewith, and bolting the inner and outer ring components together. The inner ring component can include a circular seal sleeve configured to extend from an inward portion of the inner ring component into an interior passage of a ball tube mill.

The invention further provides a trunnion seal assembly for joining a stationary inlet/outlet box of a ball tube mill to a rotational interior of the ball tube mill The trunnion seal assembly includes an outer ring component, an inner ring component, a flexible pad seal, and a mill head extension ring substantially as described above. The inner and outer filler bodies define a filler having a substantially triangular cross-sectional profile. The outer ring component includes an axially outward base of the triangular profile and the inner ring component includes an axially inward apex of the triangular profile.

In another aspect, the trunnion seal assembly includes a stationary ring component configured to be joined to an outer wall of the inlet/outlet box radially outward of the outer ring component. The stationary ring component can include a plurality of circumferential sections configured to be separated and joined for installation and removal around the outer ring component. In yet another aspect, the inner ring component, outer ring component, pad seal, and mill head extension ring can be configured and adapted to be installed and uninstalled between a rotational portion of a ball tube mill and a stationary inlet/outlet box leaving the inlet/outlet box in place.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 3:
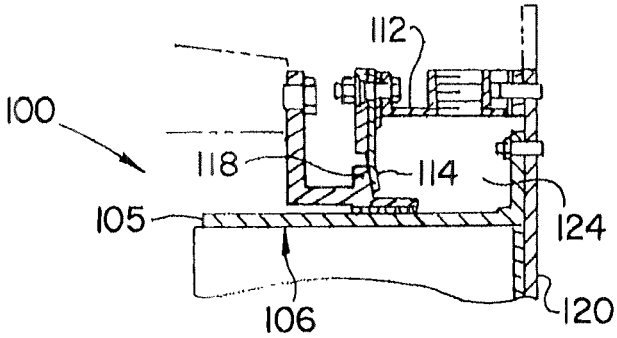
FIG. 3 is a cross-sectional side elevation view of a portion of trunnion seal constructed in accordance with the present invention, showing engagement between annular sealing surfaces of a stationary, flexible pad seal and a rotational mill head extension.

Reference will now be made to the drawings wherein like reference numerals identify similar structural features or aspects of the subject invention. For purposes of explanation and illustration, and not limitation, a partial view of an exemplary embodiment of the trunnion seal in accordance with the invention is shown in FIG. 3 and is designated generally by reference character 100. Other embodiments of trunnion seals in accordance with the invention, or aspects thereof, are provided in FIGS. 4-22, as will be described. The system of the invention can be used to increase service life and facilitate installation/removal of trunnion seals in ball tube mills.

Figure 1:
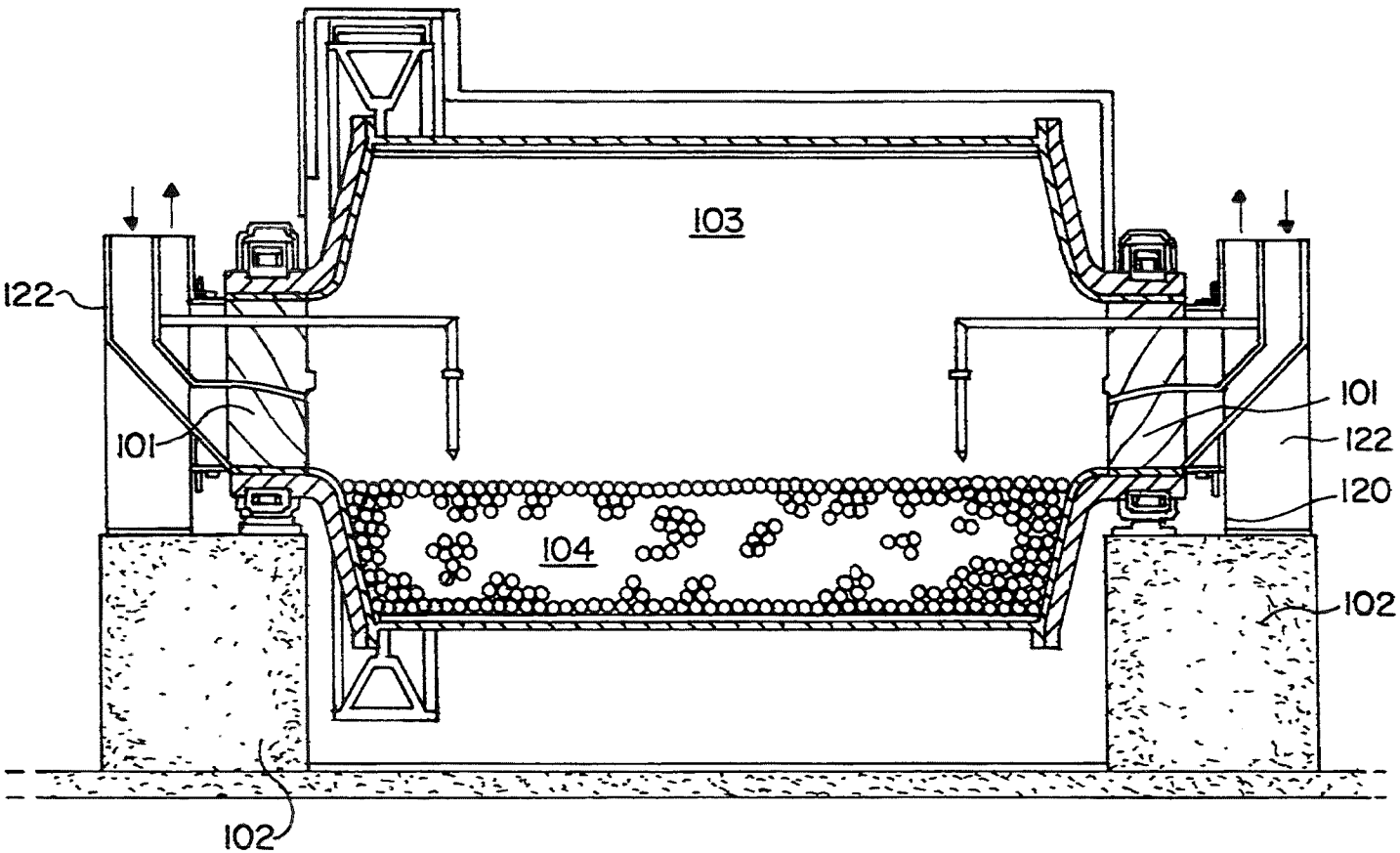
FIG. 1 (PRIOR ART)
FIG. 1 is a cross-sectional side elevation view of a ball tube mill for material size reduction, including the drum and trunnion on each end of the drum.

Ball tube mills are used in material size reduction processes, such as grinding coal or other minerals. FIG. 1 shows a ball tube mill, which rotates a drum 103 supported by a trunnion 101 on either end. As drum 103 rotates, the mass 104 of balls and coal or other material mixes in the bottom of drum 103, which reduces the particle size of the coal or other material. Particles that are fine enough become airborne and are vented out of drum 103 for use in further processes. New coal (or other material) also enters through the ends of drum 103 to replace the airborne particles leaving drum 103, as indicated by arrows in FIG. 1.

When operating a ball tube mill, eventually the seals of trunnions 101 need to be replaced. This can involve removing inlet/outlet boxes 122 from foundation blocks 102 under trunnions 101, which results in significant downtime, as discussed above.

Figure 2:
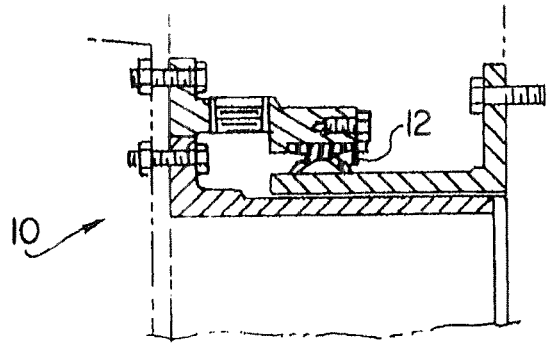
FIG. 2 (PRIOR ART)
FIG. 2 is a cross-sectional side elevation view of a portion of a prior art trunnion seal component having a split seal configuration.

Trunnion bearing ball tube mills ("btm's") employ a trunnion seal at each end that prevents fine particle dust from escaping. Originally, a split seal configuration 10 was employed, which is shown in FIG. 2. It was found, however, that effectiveness of the split seal components 12 was reduced rather quickly as the bearings of the mill wore, causing the mill axis moved downward slightly.

FIG. 3 shows seal components 114 and 118 in accordance with the invention, which can be used to replace the original seal configuration 10 and thereby extend the service life of the seal. Seal components 114 and 118 in FIG. 3 provide a longer effective sealing life because as the mill wears, drum 103 and mill head extension 118 move downward, but pad seal 114 does not loose its seal with adjacent mill head extension ring 118.

With continued reference to FIG. 3, trunnion seal 100 includes a stationary ring component 112 configured to be mounted around an inlet/outlet passage of a ball tube mill, i.e. the passage between the interior drum 103 and inlet/outlet box 122. Flexible pad seal 114 is joined to stationary ring component 112. Pad seal 114 includes a first annular sealing surface facing inward toward the interior of drum 103. Mill head extension ring 118 is joined to a rotational mill head (i.e.

at trunnion 101) proximate to and substantially concentric with stationary ring component 112. Mill head extension 118 includes a second annular sealing surface sealingly engaged with the first annular sealing surface of the flexible pad seal, as indicated in FIG. 3. The annular sealing surfaces of pad seal 114 and mill head extension 118 form a seal to discourage passage of particles within the rotating drum 103 passing into the surrounding air.

Trunnion seal 100 includes a trunnion ring 106 having a seal sleeve 105. Trunnion ring 106 is fixed with respect to stationary ring component 112, since trunnion ring 106 and stationary ring component 112 are both fixed to outer wall 120 of inlet/outlet box 122. Seal sleeve 105 has an outward facing seal face around the circumference thereof for engagement to an inward facing seal face of mill head extension ring 118, as indicated in FIG. 3. The inward facing sealing surface of mill head extension ring 118 is grooved to facilitate sealing trunnion 101. However, this is an optional feature and one or both of the sealing surfaces of mill head extension ring 118 and seal sleeve 105 can be smooth or can have any other suitable texture without departing from the scope of the invention.

An air seal channel 124 is defined between trunnion ring 106 (including seal sleeve 105), pad seal 114, and stationary ring component 112. Air seal channel 124 contains seal air which prevents or reduces pulverized coal or other materials from escaping. The annular sealing surface of mill head extension ring 118 is generally convex, as shown in FIG. 4, however, it can be also be generally concave, flat, or of any suitable contour without departing from the spirit and scope of the invention.

Figure 4:
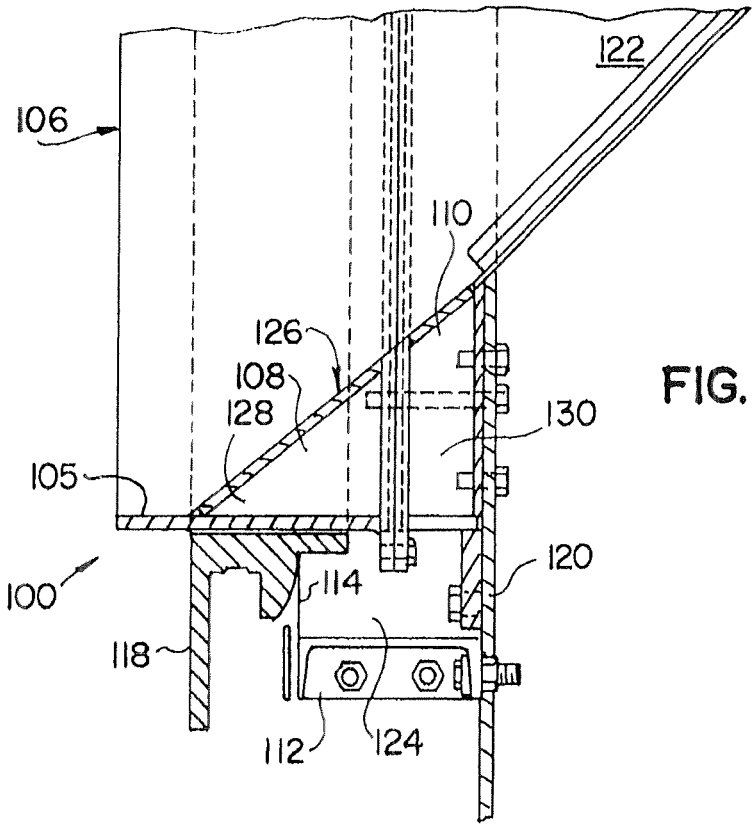
FIG. 4 is a cross-sectional side elevation view of a portion of a trunnion seal assembly constructed in accordance with the present invention, showing two portions of the trunnion seal ring combined to form a single trunnion seal ring having a wedge shaped portion forming part of an inlet/outlet passage between the drum of the mill and the inlet/outlet box.
Figure 5:
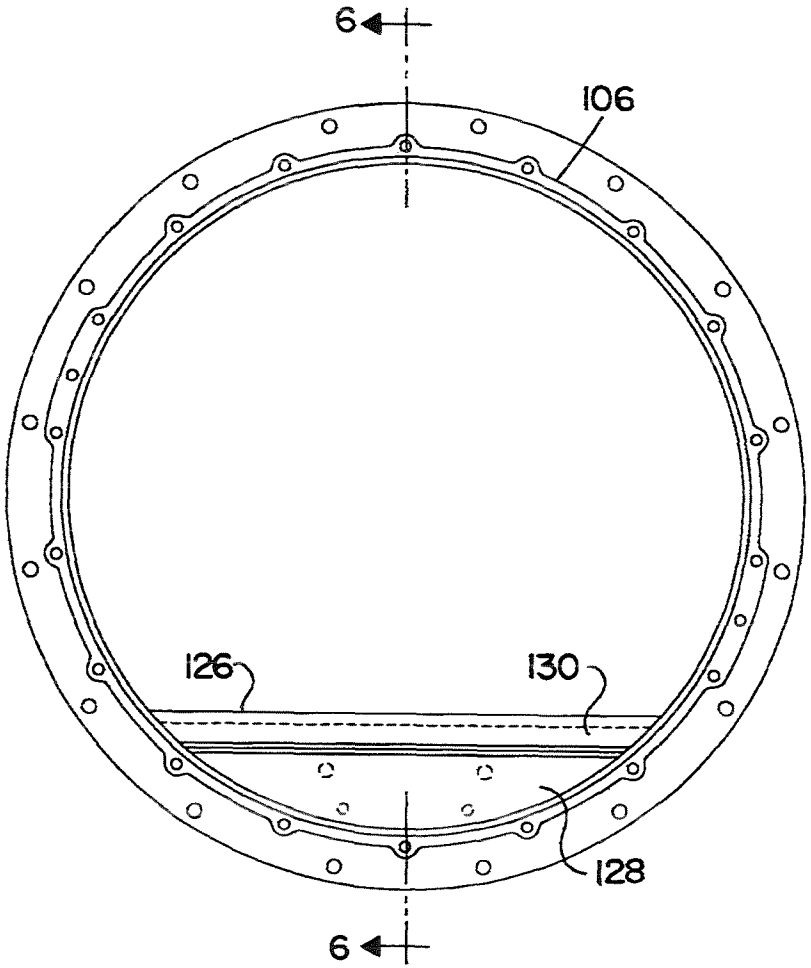
FIG. 5 is a front elevation view of the trunnion seal ring of FIG. 4, showing both portions of the trunnion seal ring together.
Figure 7:
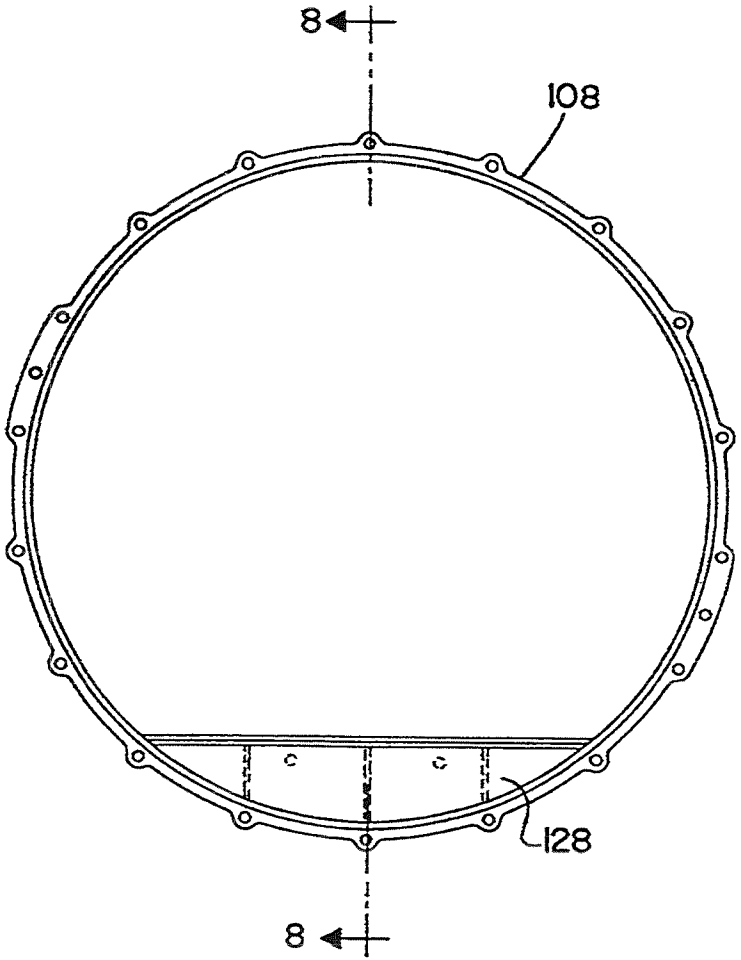
FIG. 7 is a front elevation view of the inner portion of the trunnion seal ring of FIG. 4, showing the inner part of the wedge-shaped portion.
Figure 9:
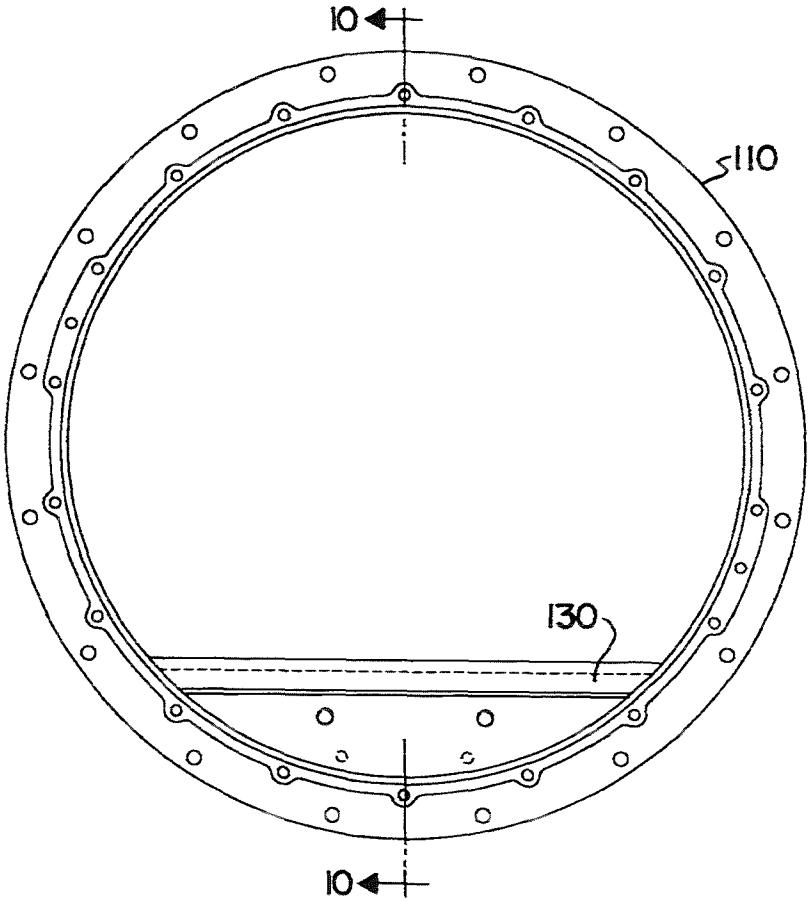
FIG. 9 is a front elevation view of the outer portion of the trunnion seal ring of FIG. 4, showing the outer part of the wedge-shaped portion.

With reference now to FIG. 4, a trunnion seal ring 106 is depicted for a ball tube mill. Seal ring 106 can advantageously used in conjunction with pad seal 114 and mill head extension 118, or with conventional trunnion seals to simplify installation and removal of trunnion seals. Seal ring 106 includes an outer ring component 110 configured to be mounted to an outer wall 120 of stationary inlet/outlet box 122 of a ball tube mill Outer ring component 110 includes an outer filler body 130 defined along a chord of a circle defined by the inner circumference of outer ring component 110, as shown in FIGS. 5 and 9. An inner ring component 108 includes an inner filler body 128 defined along a chord of a circle defined by the inner circumference thereof, as shown in FIGS. 5 and 7.

Figure 6:
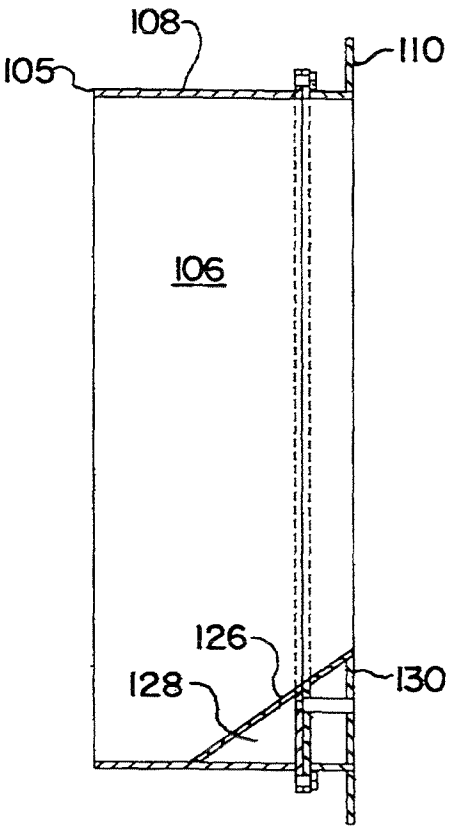
FIG. 6 is a cross-sectional side elevation view of the trunnion seal ring of FIG. 5, showing both portions of the trunnion seal ring together.
Figure 8:
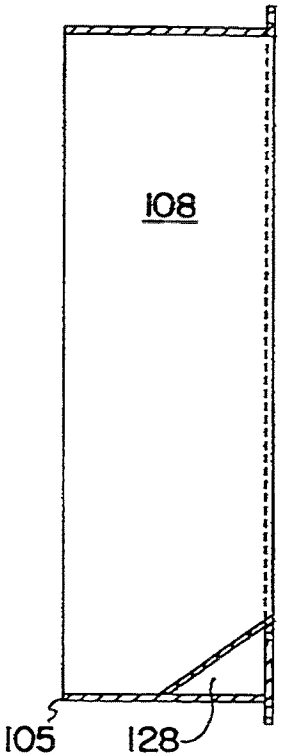
FIG. 8 is a cross-sectional side elevation view of the inner portion of the trunnion seal ring of FIG. 7, showing the inner part of the wedge-shaped portion.
Figure 10:
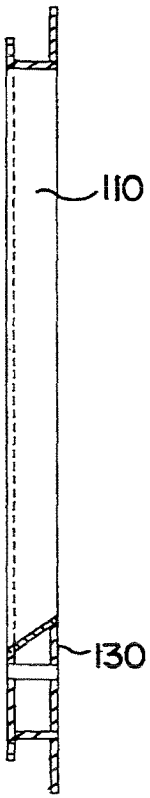
FIG. 10 is a cross-sectional side elevation view of the outer portion of the trunnion seal ring of FIG. 9, showing the outer part of the wedge-shaped portion.

Inner ring component 108 is joined to outer ring component 110 substantially concentrically with inner and outer filler bodies 128/130 defining a filler 126 having a substantially triangular cross-sectional profile, as shown in FIGS. 4 and 6. Assembled trunnion ring 106, inner ring component 108, and outer ring component 110 are shown in cross-section from the side in FIGS. 6, 8, and 10, respectively. As shown in FIG. 10, outer ring component 110 includes an axially outward base of the triangular profile of filler 126, and as shown in FIG. 8, inner ring component 108 includes an axially inward apex of the triangular profile of filler 126. Filler 126 forms a portion of the chute for moving material between inlet/outlet box 122 and drum 103 (compare FIG. 1).

The two-part construction of trunnion ring 106 allows installation and removal thereof without the need to remove inlet/outlet box 122 from foundation block 102, as will be described in greater detail below. This is an advantage over conventional trunnion rings, for which the corresponding inlet/outlet box 122 is removed during installation and removal.

Figure 13:
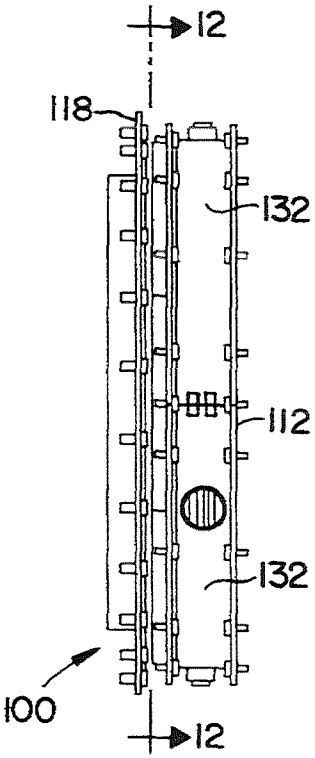
FIG. 13 is a side elevation view of the trunnion seal assembly of FIG. 11, showing the circumferential sections of the stationary ring component.
Figure 12:
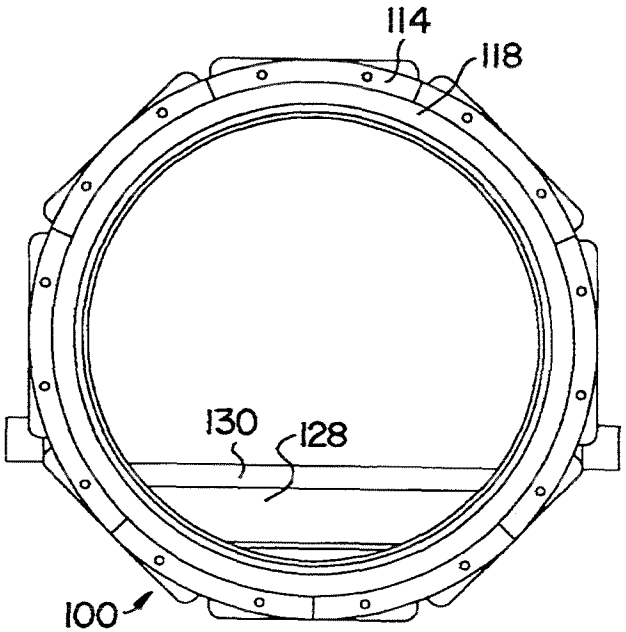
FIG. 12 is a cross-sectional front elevation view of the trunnion seal assembly of FIG. 11, showing the flexible pad seal member engaged with the sealing surface of the mill head extension.
Figure 11:
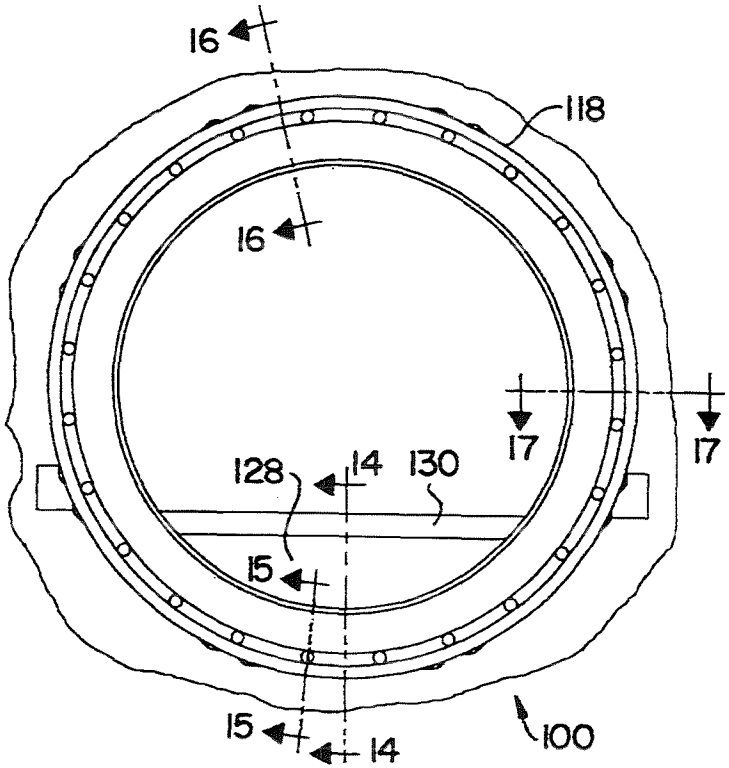
FIG. 11 is a front elevation view of a trunnion seal assembly constructed in accordance with the present invention, showing the assembly as viewed from the mill side of the seal.
Figure 14:
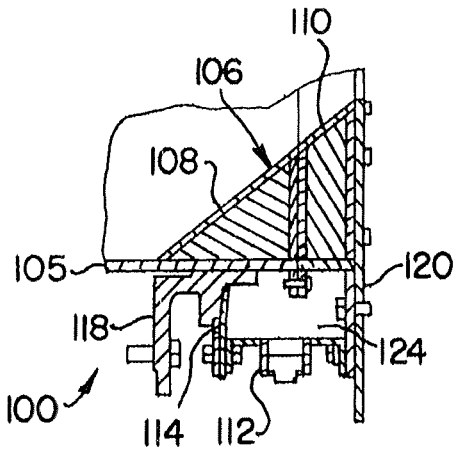
FIG. 14 is a cross-sectional side elevation view of a portion of the trunnion ring seal assembly of FIG. 11, showing a cross-section taken along section line 14-14 of FIG. 11.
Figure 15:
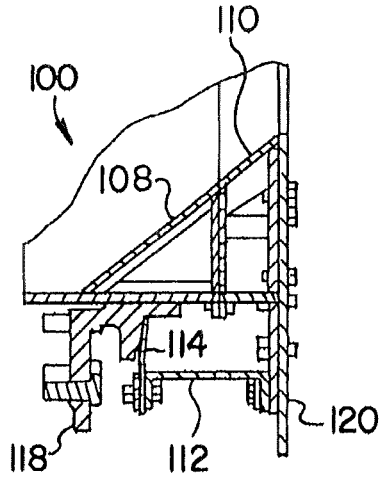
FIG. 15 is a cross-sectional side elevation view of a portion of the trunnion ring seal assembly of FIG. 11, showing a cross-section taken along section line 15-15 of FIG. 11.
Figure 16:
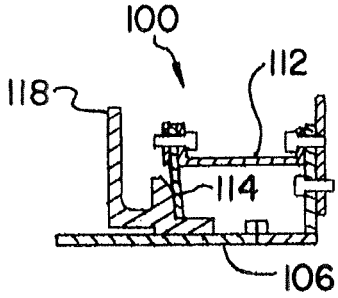
FIG. 16 is a cross-sectional side elevation view of a portion of the trunnion ring seal assembly of FIG. 11, showing a cross-section taken along section line 16-16 of FIG. 11.
Figure 17:
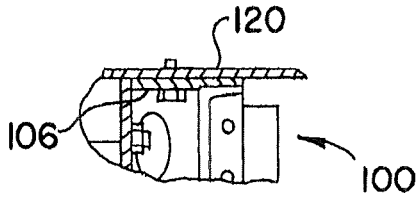
FIG. 17 is a cross-sectional plan view of a portion of the trunnion ring seal assembly of FIG. 11, showing a cross-section taken along section line 17-17 of FIG. 11.

As shown in FIGS. 11-17, trunnion ring 106, mill head extension 118, stationary ring component 112, and pad seal 114 combine to form a trunnion seal assembly to join stationary inlet/outlet box 122 to the rotational interior of a ball tube mill FIG. 11 shows a view of the assembly of trunnion seal 100 as seen from the mill side. FIG. 12 shows a similar, albeit cross-sectional view taken along section line 12-12 indicated in the side elevation view of FIG. 13. FIG. 13 shows that stationary ring component 112 includes a plurality of circumferential sections 132 that can be separated and joined for installation and removal of stationary ring component 112 around inner and outer ring components 108/110. Pad seal 114 is shown in FIG. 12 with circumferential sections, and mill head extension 118 can also advantageously be sectioned circumferentially. FIGS. 14-17 show cross sectional views of the trunnion seal assembly of FIGS. 11-13 taken along section lines 14-14, 15-15, 16-16, and 17-17, respectively.

Figure 19:
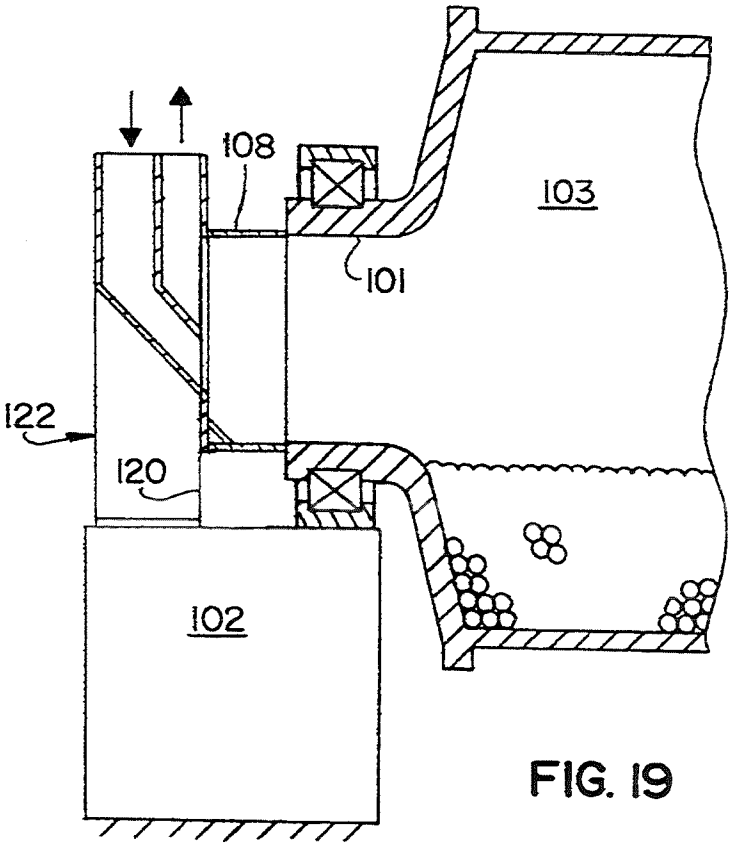
FIG. 19 is a schematic view of a second step of installing a trunnion seal ring, showing the inner ring component being aligned with the opening of the drum.
Figure 18:
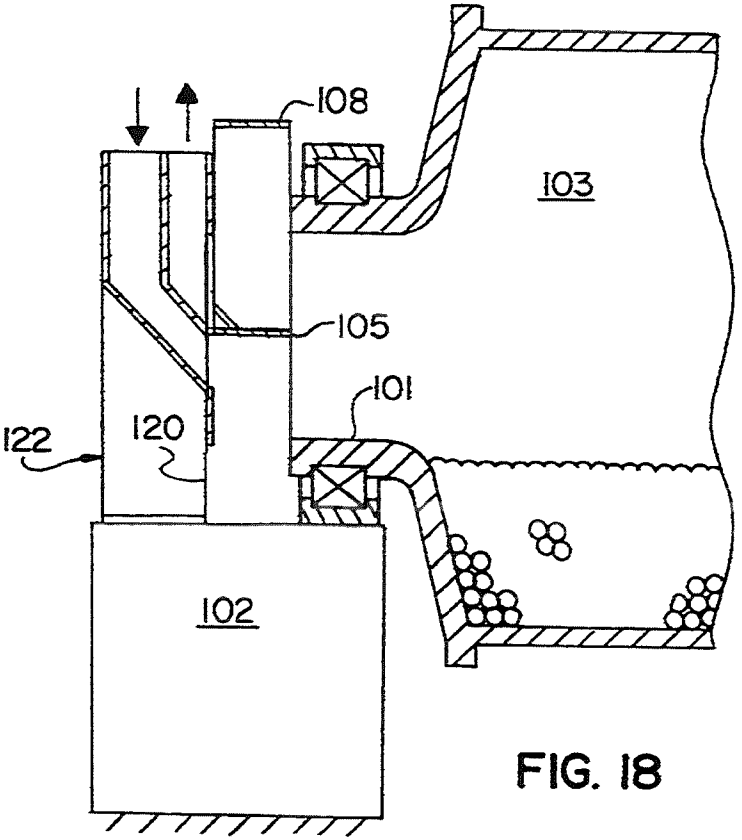
FIG. 18 is a schematic view of a first step of installing a trunnion seal ring in accordance with the present invention, showing the inner ring component being positioned between the inlet/outlet box and the drum of the mill.
Figure 20:
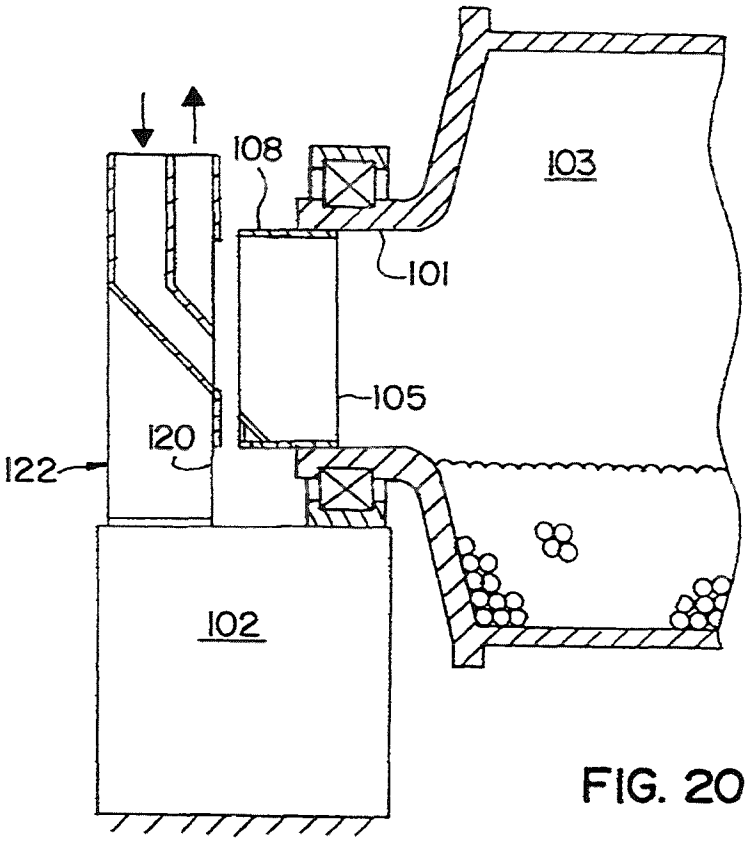
FIG. 20 is a schematic view of a third step of installing a trunnion seal ring, showing the inner ring component positioned partially within the drum.

Referring now to FIGS. 18-22, a method of installing the trunnion seal assembly of FIG. 11 is shown. As shown in FIG. 18, inner ring component 108 is installed first, with the seal sleeve 105 retracted out from, but directed toward the ball tube mill, with the outermost portion of inner ring component 108 close to outer wall 120 of inlet/outlet box 122. FIG. 18 shows inner ring component 108 being inserted between trunnion 101 and inlet/outlet box 122 vertically, however this is for sake of clarity. Inner ring component 108 can also be brought into position laterally, or from any suitable direction. FIG. 19 shows inner ring component 108 between trunnion 101 and inlet/outlet box 122, and substantially concentric with drum 103. In this position, inner ring component is then shifted partially into trunnion 101, as shown in FIG. 20.

Figure 21:
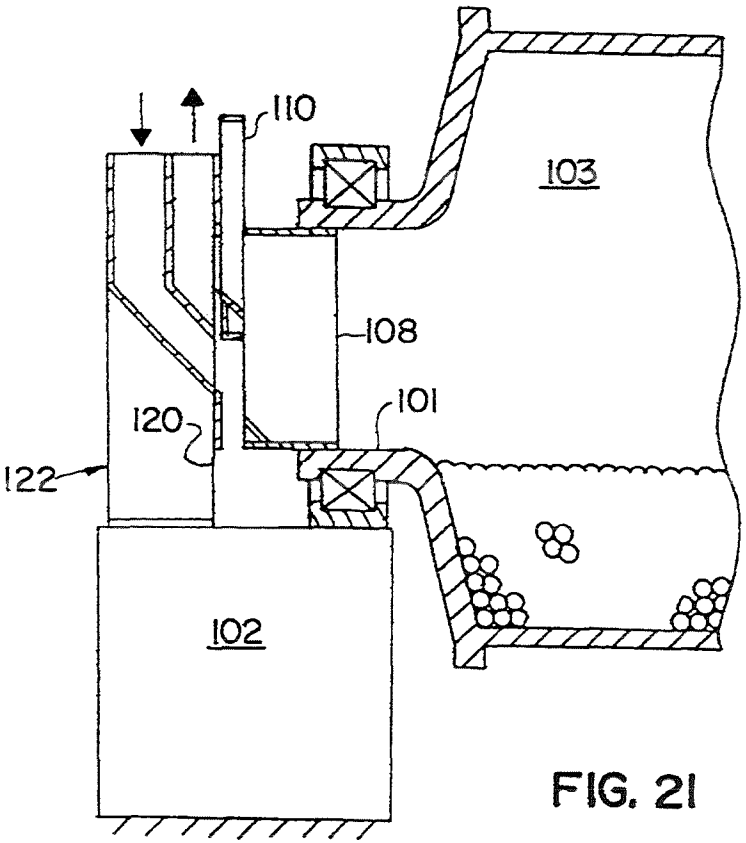
FIG. 21 is a schematic view of a fourth step of installing a trunnion seal ring, showing the outer ring component being positioned between the inlet/outlet box and the inner ring component.
Figure 22:
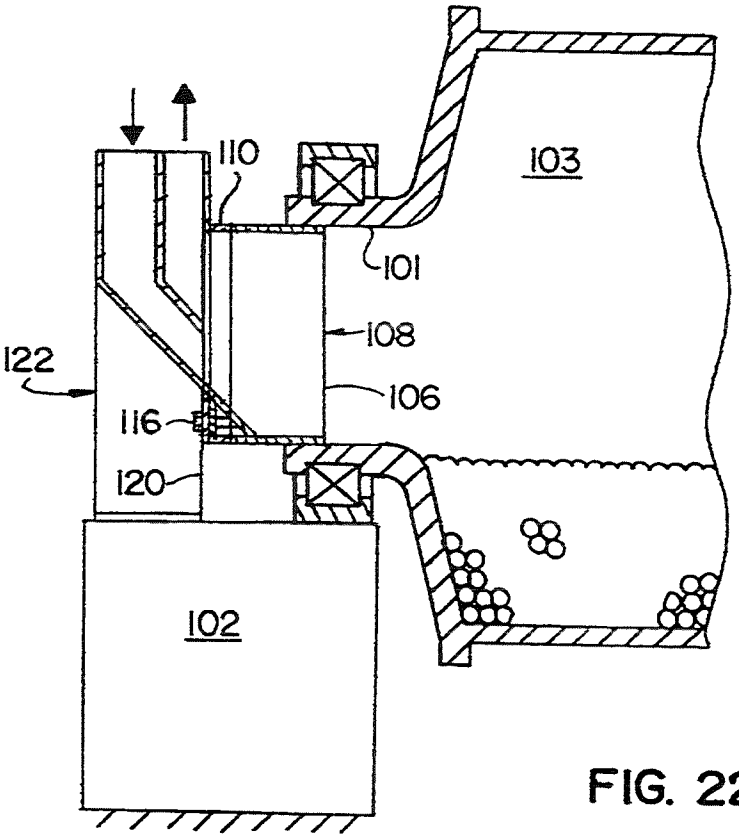
FIG. 22 is a schematic view of a fifth step of installing a trunnion seal ring, showing the inner and outer ring components joined together.

Outer ring component 110 is then positioned between inlet/outlet box 122 and inner ring component 108 (from any suitable direction including vertically as shown in FIG. 21). Once outer ring component 110 is properly aligned, it can be joined to inner ring component 110 to form trunnion ring 106, as shown in FIG. 22. It is contemplated that one or more bolts 116 can be used to join ring components 108/110 together while also joining them to outer wall 120 of inlet outlet box 122. The positioning of one or both of ring components 108/110 can include shimming or any other suitable technique. Other components, e.g., pad seal 114 and mill head extension ring 118 can be installed during this process. It is also possible to install components having circumferential sections (e.g., stationary ring component 112 with circumferential sections 132) after trunnion ring 106 has been assembled into place. The reversing of these procedures, or similar steps, can be used to remove the trunnion ring assembly. All of this can be done without removal of inlet/outlet box 122.

Since the inlet/outlet box assembly does not have to be removed to accommodate the installation of the components of trunnion seal 100, approximately two days of maintenance labor per seal are saved during installation or replacement of trunnion seals. And where there are two seals per ball tube mill, the total savings is approximately four days of maintenance labor per mill, which means four days less of lost generation capability. These advantages result from the two-part construction of trunnion ring 106, which can be positioned laterally into place one part at a time as described above, and removed by the reverse process.

The methods and systems of the present invention, as described above and shown in the drawings, provide methods and systems with superior properties including improved service life and ease of installation and removal, leading to reduction of downtime for ball tube mills While the apparatus and methods of the subject invention have been shown and described with reference to preferred embodiments, those skilled in the art will readily appreciate that changes and/or modifications may be made thereto without departing from the spirit and scope of the invention.

What is claimed is:

1. A trunnion seal assembly for a ball tube mill comprising:

a) a stationary ring component configured to be mounted around an inlet/outlet passage of a ball tube mill;

b) a flexible pad seal joined to the stationary ring component, the pad seal including a first annular sealing surface;

c) a mill head extension ring configured to be joined to a rotational mill head proximate to and substantially concentric with the stationary ring component, the mill head extension including a second annular sealing surface sealingly engaged with the first annular sealing surface of the flexible pad seal, the first and second annular sealing surfaces forming a seal to discourage passage of particles within the mill passing into the surrounding air;

d) an outer ring component mounted to the stationary ring component, the outer ring component including an outer filler body defined along a chord of a circle defined by the inner circumference of the outer ring component, the outer filler body defining a triangular base; and e) an inner ring component including an inner filler body defined along a chord of a circle defined by the inner circumference thereof, the inner filler body defining a triangular apex, the inner ring component being joined to the outer ring component substantially concentrically with the inner and outer filler bodies defining a filler having a substantially triangular cross-sectional profile defined by the triangular base and apex.

2. A trunnion seal assembly as recited in claim 1, further comprising a seal sleeve joined to the stationary ring component and having an outward facing seal face around the circumference thereof configured for engagement to an inward facing seal face of the mill head extension ring.

3. A trunnion seal assembly as recited in claim 2, wherein at least one of the inward facing seal face of the mill head extension ring and the outward facing seal face of the stationary ring component is grooved.

4. A trunnion seal assembly as recited in claim 2, wherein an air seal channel is defined between the seal sleeve, pad seal, and stationary ring component.

5. A trunnion seal assembly as recited in claim 1, wherein the second annular sealing surface is generally convex.

6. A trunnion seal assembly as recited in claim 1, wherein the second annular sealing surface is generally flat.

7. A trunnion seal ring assembly for a ball tube mill comprising:

a) an outer ring component configured to be mounted to an outer wall of a stationary inlet/outlet box of a ball tube mill, the outer ring component including an outer filler body defined along a chord of a circle defined by the inner circumference of the outer ring component, the outer filler body defining a triangular base; and b) an inner ring component including an inner filler body defined along a chord of a circle defined by the inner circumference thereof, the inner filler body defining a triangular apex, the inner ring component being joined to the outer ring component substantially concentrically with the inner and outer filler bodies defining a filler having a substantially triangular cross-sectional profile defined by the triangular base and apex;

c) wherein the inner ring component includes a seal sleeve having an outward facing seal face.

8. A trunnion seal ring assembly as recited in claim 7, wherein the inner and outer ring components are configured to be assembled into a ball tube mill by positioning the inner ring component partially into the ball tube mill so the inner ring component is substantially concentric with the ball tube mill, then inserting the outer ring component axially outside the inner ring component and into alignment therewith, and bolting the inner and outer ring components together.

9. A trunnion seal ring assembly as recited in claim 8, wherein the inner ring component includes a circular seal sleeve configured to extend from an inward portion of the inner ring component into an interior passage of a ball tube mill.

* * * * *